US005772037A

United States Patent [19]

Hurley

[11] Patent Number: 5,772,037

[45] Date of Patent: Jun. 30, 1998

[54] SHIPPING PROTECTOR

[76] Inventor: Richard D. Hurley, 3210 NW. McKinley Dr., Corvallis, Oreg. 97330

[21] Appl. No.: 556,000

[22] Filed: Nov. 15, 1995

[51] Int. Cl.[6] ..... B65D 85/30

[52] U.S. Cl. ..... 206/586; 206/594

[58] Field of Search ..... 206/521, 586, 206/591, 592, 593, 594, 453; 248/345.1

[56] References Cited

U.S. PATENT DOCUMENTS

| | | | |
|---|---|---|---|
| 3,762,626 | 10/1973 | Dorsey | 229/14 C |
| 4,120,441 | 10/1978 | Hurley | 206/586 |
| 4,742,916 | 5/1988 | Galea | 206/586 |
| 4,838,427 | 6/1989 | Hurley | 206/586 |
| 4,877,673 | 10/1989 | Eckel et al. | 206/586 X |
| 5,267,651 | 12/1993 | Hughes | 206/586 |
| 5,335,770 | 8/1994 | Baker et al. | 206/443 |

*Primary Examiner*—Jacob K. Ackun
*Attorney, Agent, or Firm*—Dellett and Walters

[57] ABSTRACT

A shipping protector for use along edges, corners or faces of shipped articles comprises a series of spaced lands with furrows therebetween. The furrows and lands define a herringbone type or otherwise angled pattern for preventing entry of articles into the rib regions. A banding saddle provides reinforcement in the region for receiving a banding strap and also assists the band in staying in position. The tactile surface of the protector assists in engaging with stretch or shrink wrap.

69 Claims, 7 Drawing Sheets

SHIPPING PROTECTOR

This invention relates to shipping protectors and more particularly to an edge protector, a corner protector and a face protector for providing protection between a shipped article and its packaging or external restraints.

BACKGROUND OF THE INVENTION

It is current practice in the shipping arts to employ package cushioning to protect an article during shipping. The cushioning typically is interposed between the article being shipped and the exterior packaging which may comprise, for example, a corrugated container or box, corrugated endcaps or top and bottom caps, or shrink or stretch wrap film. The exact nature of the article shipped can vary widely, from furniture to machine parts, other industrial or consumer products, or any other item. Package cushioning is typically made of foam material, single or multiple plies of honeycomb or corrugated, or of molded fiber, wherein the cushioning takes on a particular shape to fit along corners or edges of the article being shipped.

In accordance with known protectors, for example an edge protector as shown in U.S. Pat. No. 4,120,441 (Hurley) and as illustrated in FIG. 1, the edge protector is formed from two molded fiber walls 10, 12, with first edges joined to place the walls in substantially 90° relation when in place. The walls are indented at intervals with ribs 26 at 90° angles, denoted $\Theta_3$, to the longitudinal length of the edge protector, forming portions 22 which project inwardly toward the object being shipped to maintain the object in spaced relation to the shipping container. A continuous groove 28 may be defined at the joining position of walls 10, 12.

Since the particular shipping use of a given protector may vary, it is desirable to manufacture the protectors in standard lengths, and enable the end user to relatively easily trim the protector to its particular desired size. Spaced tear slots 32 enable separation of the edge protector into separate pieces. Some prior art protectors employ two parallel slightly raised portions in spaced relation to each other to define a pseudo tear line along the center bottom of selected ribs. However, the protectors using such parallel raised portions do not provide a "clean" break or tear line.

A current trend in shipping, called "RTA"—Ready-to-Assemble, is to ship furniture, for example book cases, in a disassembled state, wherein plural panels or the like are stacked within the shipping container, one atop the other, in order to save space, whereupon at arrival at the destination, the furniture item is removed from the shipping container for assembly. Shipping space is thereby conserved. However, with prior art type shipping protectors, portions of the stacked furniture pieces can fit within the ribbed protector portions, with the result that the particular piece, which may comprise a shelf, for example, can slide into a rib portion during shipping, thereby defeating the cushioning effect of the edge protector. Since the shelf is no longer maintained in spaced relation to the shipping container, the shelf may be subject to damage, since it is separated from the container wall only by the thickness of the shipping protector wall, instead of having a spaced shock absorbing piece thereagainst. Further, if the portion of the article fits within the rib area, the article portion will likely move around during shipping, resulting in abrading between the adjacent stationary pieces and the moving piece. FIG. 1 illustrates a shelf 30 undesirably sliding into rib portions 26' and 26". The edges of the shelf, and especially the shelf corner 34 are then not protected to the desired degree and can be damaged in the event of an external impact to the shipping container, since the shelf is not resting against portions 22, which would provide the desired spacing and cushioning between the shelf 30 and the shipping container.

A further issue which can arise when employing edge protectors in accordance with the prior art (see also U.S. Pat. No. 4,742,916, Galea) is that the edge protector, especially when manufactured of molded fiber, has a tendency to hinge about line 13 along the longitudinal ridge where the first and second edges of the edge protector join together. Such hinging action can be objectionable in certain applications, since the hinging may tend to cause the edge protector to split down line 13 or at other locations along the longitudinal ridge, reducing the protection afforded by the protector.

It is often desirable in shipping to employ straps or banding or pressure-sensitive tape to hold edge protectors in secure relation to the article being shipped. Such banding may comprise a metal or nylon strap, for example. In accordance with prior art protectors, the use of a banding strap can lead to undesirable crushing of the edge protector, especially in the region where the first and second edges are joined. Such crushing is objectionable as it destroys the physical spacing between the corner edge of the article being protected and the banding.

Heat shrink or stretch type film wrapping, suitably of plastic, is also employed with some applications to surround the shipped article and any protectors. With heat shrink and stretch type wraps, after initial wrapping, the wrap tends to "relax" somewhat and sag. Prior art type edge protectors are thus not held as securely to the article as desired. Further the smoother outward surfaces of prior art edge protectors, especially those of foam construction or single or multi-ply corrugated or chipboard or honeycomb, do not provide a suitable surface for engagement by the shrink or stretch wrap.

It is also desirable to have shipping protectors fail in a controlled or predictable manner without the likelihood of damage to the article being shipped. This is especially important when shipping furniture items or the like. Further, if the shipping protector presents an unblunted profile at the edges thereof, in the event of impact or as a result of vibration during the shipping process, the sharp protector edge can mar the article being shipped, especially in the case of furniture which may be shipped with a newly applied finish that is still somewhat prone to plastic deformation.

SUMMARY OF THE INVENTION

According to the present invention, a protector for placement along an edge, corner or face of a shipped article comprises an edge portion which has plural first lands in spaced relation thereon to define a first face of the protector adapted to contact the article being protected. Furrows separate the lands wherein the furrows are oriented at angles of less than 90° relative to the longitudinal axis of the protector.

The protector may employ first and second edge portions, where the first and second edge portions each have plural lands with furrows therebetween, wherein the furrows are oriented at angles of less than 90° to provide a herringbone pattern. Alternatively, an angled-aligned pattern orientation may be employed. A further embodiment makes use of anti-hinging means to strengthen the protector against hinging type flexing during use.

It is accordingly an object of the present invention to provide an improved edge, corner or face protector for use in shipping.

It is a further object of the present invention to provide an improved protector which maintains the protected article in contact with the land portion of the protector, for preventing the article from entering the rib portion of the edge protector.

It is another object of the present invention to provide an improved shipping protector which includes a banding region adapted to receive a securing strap or band therein without substantial crushing of the edge protector.

It is yet another object of the present invention to provide an improved shipping protector which is resistant to hinging movement.

It is also an object of the present invention to provide an improved shipping protector which has a progressive failure profile allowing initial deformation while providing residual protection after multiple shocks or against an excessive shock.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 2:
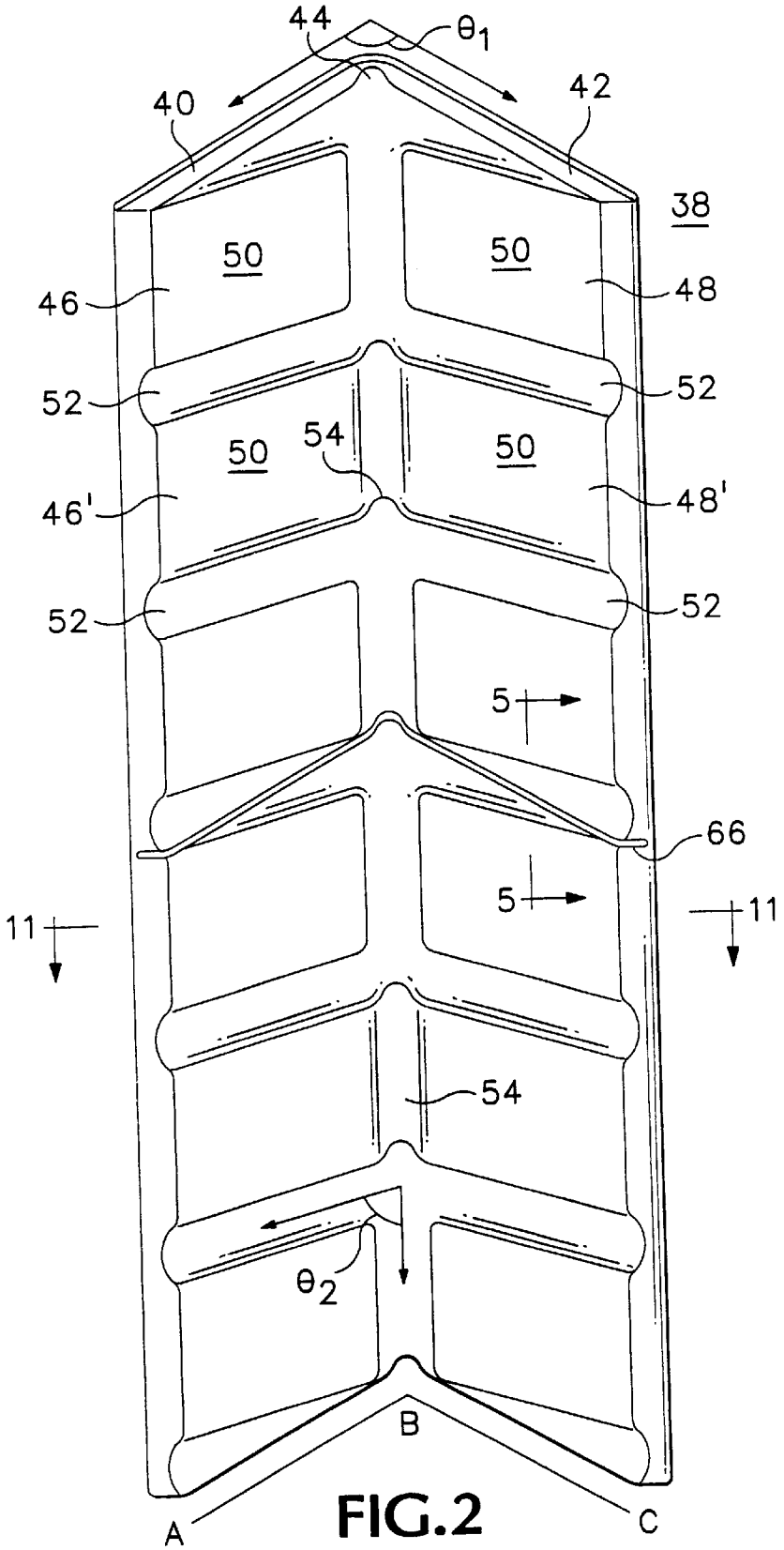
FIG. 2 is an inside perspective view of an edge protector according to the present invention.

Referring now to FIG. 2, which comprises an inside perspective view of an edge protector 38 according to the present invention, the edge protector comprises first and second edge portions 40, 42 which are suitably joined together at tunnel portion 44. Formed along each of the edge portions are a series of spaced lands 46 and 48, lands 46 being positioned at the first edge 40 and lands 48 being positioned on the second edge 42. The lands project inwardly such that the inward face of the protector provides a series of land faces 50 which are adapted to contact respective faces, for example, of an article being shipped, also known as the "product". The two edge portions are constructed so that they form an angle of $\Theta_1$ which is slightly less than 90° relative to the two inner faces of the edge portions. The respective lands on a given face are separated from one another by rib portions 52 which define furrows between the land portions. Tunnel 44 separates the innermost edges of lands 46 and 48, to thereby define the tunnel which runs along the center of the edge protector 38. After a given number of lands 46 and 48 are placed in spaced relation to one another, with tunnel 44 therebetween, tunnel 44 is interrupted by anti-hinge member 54 which suitably substantially connects a portion of a particular land 46' to its corresponding land 48' on the opposite side of the edge protector.

Figure 3:
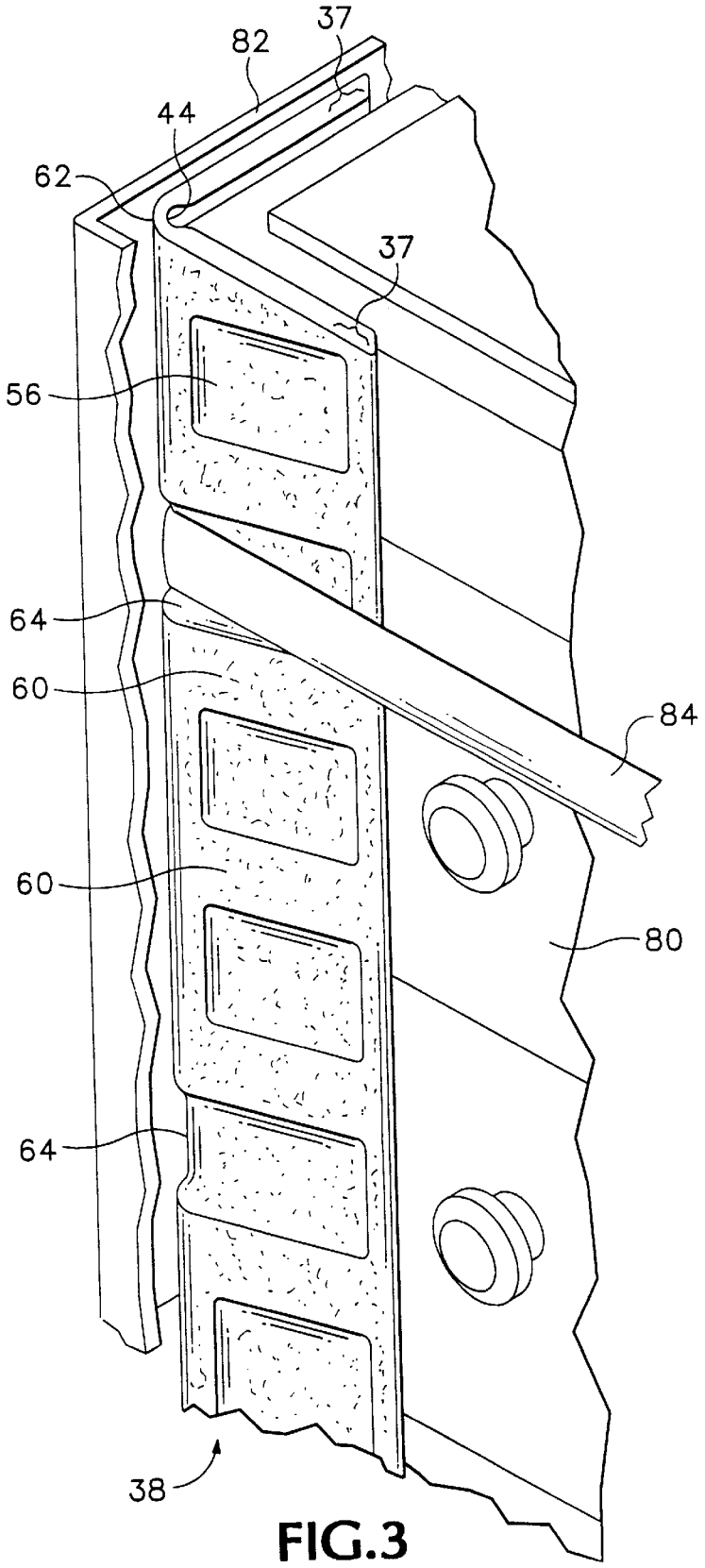
FIG. 3 is an outside perspective view of an edge protector according to the present invention when installed on an article being shipped.

Referring now to FIG. 3, which is an outside perspective view of an edge protector according to the present invention, showing a typical application, on the exterior of the edge protector, in regions opposite lands 46 and 48, corresponding wide furrows 56 and 58 (not visible in FIG. 3) are formed, corresponding to lands 46 and 48 respectively, while raised portions 60 correspond to furrows 52. The various raised portions, as well as the indented regions 56 and 58 suitably are not substantially smooth surfaces, but instead are provided with a crinkle-like surface finish at the exterior of the edge protector. Opposite tunnel portion 44 is a semicircular or arcuate portion 62 which is also suitably of a roughened texture. In the region of the protector which is suitably opposite anti-hinge portion 54 (although this is not a requirement) is a band receiving region 64 which defines a saddle-like depression out of the plane tangent to the exterior of portion 62.

Figure 1:
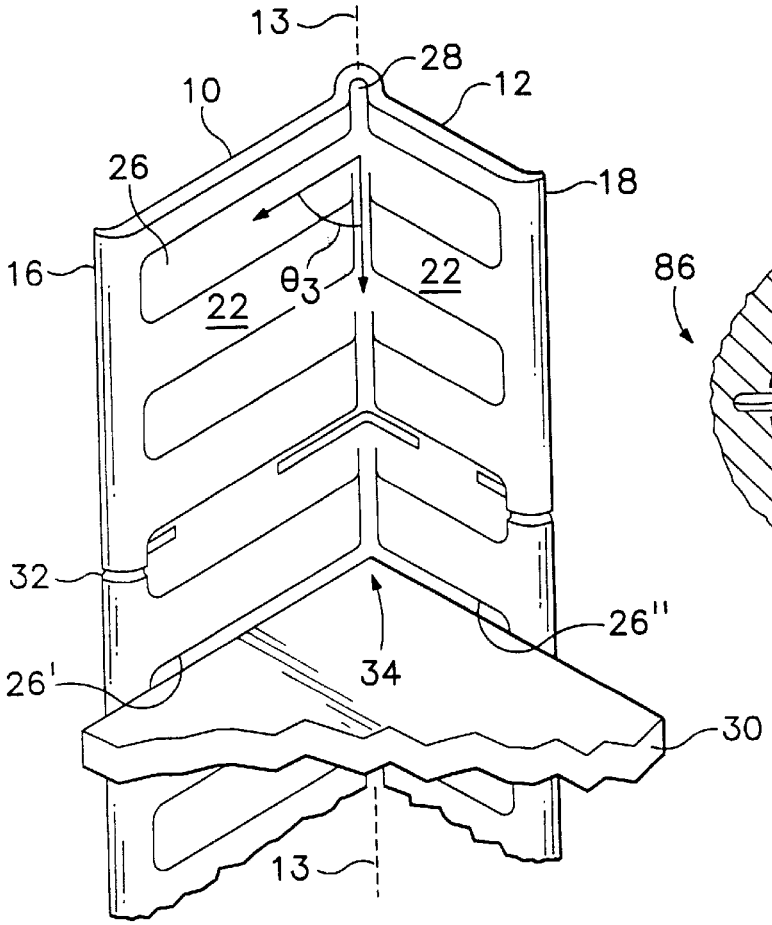
FIG.1 (PRIOR ART)
FIG. 1 is a view of an edge protector in accordance with the prior art, illustrating entry of a portion of an article into the rib channels of the protector.

Referring again to FIG. 2, the placement of the lands and furrows relative to the longitudinal axis of the protector differ from the angles used in accordance with the prior art. Referring to FIG. 1, in accordance with the prior art, the ribs and lands were at an angle $\Theta_3$ of 90°, thus enabling undesired entry of certain articles into the rib regions as discussed hereinabove in connection with FIG. 1. Referring again to FIG. 2, in accordance with the present invention, the furrows between the lands are oriented at an angle $\Theta_2$ which is less than 90°, providing a herringbone type pattern to the furrows (which form ribs when viewed from the exterior). A particular embodiment employs an angle of $\Theta_2$ of 72°, although angles greater than 0° and less than 90° may be employed (or greater than 90° and less than 180°). However, as the angle becomes closer to 0° (or 180°), particular manufacturing requirements for molded products may require that the ribs employ a greater width in order to enable the protector to release from a mold, which can reduce the available weight bearing area remaining for the lands between ribs.

Figure 6:
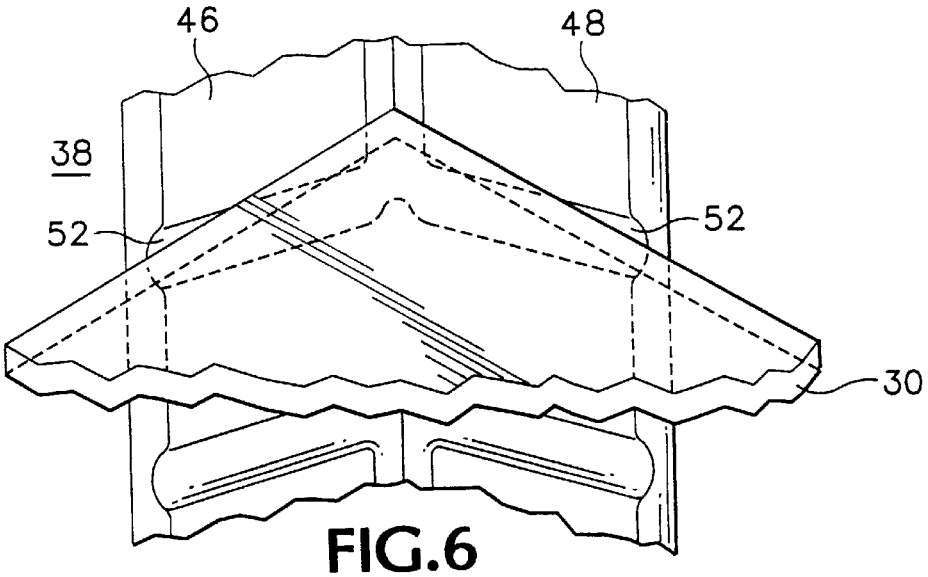
FIG. 6 is a view showing the non-entry of articles into the rib channels of the edge protector according to the present invention.

An advantage provided by the edge protector may be better understood by referring to FIG. 6, which is a perspective view of an edge protector 38 in accordance with the present invention, wherein an article, for example shelf portion 30, is abutted against the inner face of the protector. Since the furrow portions 52 are at angles other than 90° to the longitudinal axis of the protector, the shelf 30 is prevented from entering into the rib or furrows 52, since the furrows do not align with the plane of the shelf 30. Accordingly, at least portions of a particular land 46 or several lands 46 and also land or lands 48 are in abutting relation to the shelf, and only part of the shelf spans the furrows 52. The shelf does not enter the furrow since a plane normal to the furrow is skewed relative to the plane of orientation of the shelf. The present invention accordingly provides an improved edge protector which does not allow the shelf to move flush against the furrows and tunnel portion during shipping.

Referring again to FIG. 2, a score line 66 is provided wherein the score line traverses essentially only the furrow portion of a particular furrow, thus providing a separation line along which the edge protector may be relatively easily separated into several pieces. The score line 66 suitably comprises a region of the protector which is of slightly less thickness in the walls, thus providing sufficient strength to remain as one piece if desired, while still enabling relatively easy separation if the user desires to have a edge protector portion of shorter length. The score line is oriented to provide a square face upon separation (i.e. at 90° to the longitudinal axis of the protector).

Figure 5:
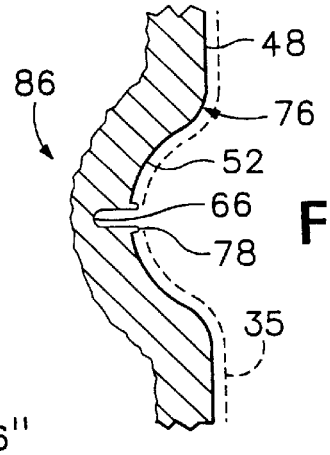
FIG. 5 is a cross sectional view of an edge protector according to the present invention illustrating the transition shape between lands and ribs.

Referring now to FIG. 5, which is cross sectional view of the edge protector of FIG. 2, taken along line 5—5 thereof, the configuration of a land 48 relative to rib 52 may be observed. The edges of the lands where the transition occurs between the land and rib at position 76 in FIG. 5 are smoothly radiused and the rib portion 52 extends downwardly at an angle of less than 90°, to provide a crushable structure in the event of impact wherein land 48 and/or rib region 52 will progressively deform to provide a progressive controlled failure. Edge portion 76 will smoothly roll rather than forming a sharp edge on impact or application of heavy static loading which could potentially damage the article being protected.

Still referring to FIG. 5, the score line 66 may be observed. When the edge protector is constructed of molded fiber, for example molded paper pulp fiber, the process of forming the score line 66 may comprise using a knife to define the score line after the protector is removed from the mold. In the process of molding fiber, paper pulp is formed from a mixture of paper and water and the protector is typically formed through a molding process and then dried. As the protector comes out of the mold and prior to drying, it is typically 75 percent water and is easily subject to deformation. Accordingly, as the knife is drawn along the article so as to form the score line 66 (or as the article is pressed against the knife), when the knife is removed, the pulp material forms a lip portion 78 as a result of the consistency of the still wet pulp. This raised portion 78 can lead to undesirable marring if it is allowed to contact the article being shipped in particular applications (finished furniture, for example) since once the protector is dried it is fairly rigid and stiff. Accordingly, the edge protector according to the present invention orients the score line 66 so as to be entirely contained within furrow 52 and tunnel 44. Therefore, the raised portions 78 are well below the height of lands 46 and 48, enabling a wide contact area against the article being shipped, rather than having sharp edge contacts against lip portions 78. Marks are thereby prevented in the furniture. These marks could typically arise as a result of the manufacturing process of furniture wherein a finish is applied to the furniture, or the furniture is polished or retouched just prior to shipment. Although the finish may be essentially dry, it is still subject to plastic deformation as a result of pressure thereagainst, so it is desirable to avoid a thin contact line which would be provided by the raised portion 78. Instead, the protector of the present invention provides a wide surface along the face of the lands 46 and 48, spreading the contact pressure over a relatively large area and thereby reducing the likelihood of the finish being marred.

Referring again to FIG. 3, the use of banding saddle 64 may be observed. In FIG. 3, the furniture article 80 is contained within a shipping container 82 which may comprise a corrugated container or box, for example, while a protector 38 according to the present invention is positioned along an edge of the furniture article, to provide protection during shipping so that the furniture edges are not damaged. The protector also keeps the furniture item securely braced within the container. In some applications, a band 84 made of metal or plastic or other fiber may be strapped around the article and the edge protectors, to maintain the protectors in position during shipping. The band saddle 64 accordingly receives the band 84 therein and assists in the band staying in contact with the protector at the desired position. Further, the structure of the band saddle as well as the lack of a tunnel portion (or a more sturdy tunnel portion as a result of anti-hinge member 54) on the inner face opposing the band saddle provides a sturdy crush resistant structure. If the band is applied on a tunnel portion in accordance with prior art protectors, there is a likelihood that when the band is cinched up tight, the tunnel portion will be crushed, resulting in loosening of the band or potentially damaging of the furniture.

Figure 11:
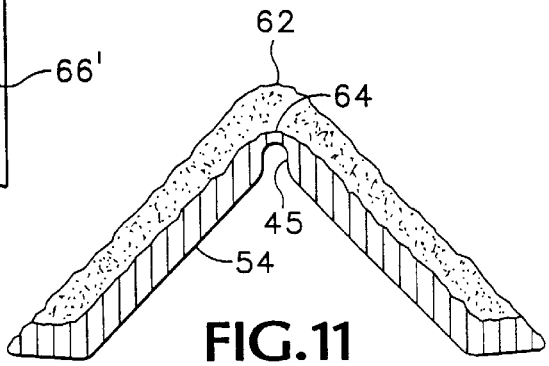
FIG. 11 is a cross sectional view of the protector of FIG. 2 taken along line 11—11 of FIG. 2.

FIG. 11, which is a cross sectional view of the protector of FIG. 2 taken along line 11—11 of FIG. 2, illustrates the configuration of the band saddle 64 and anti-hinge member 54. A mini tunnel 45 may suitably be provided where the lands/anti-hinge member meet at the center of the protector, to define a smaller tunnel space than tunnel 44.

Figure 9:
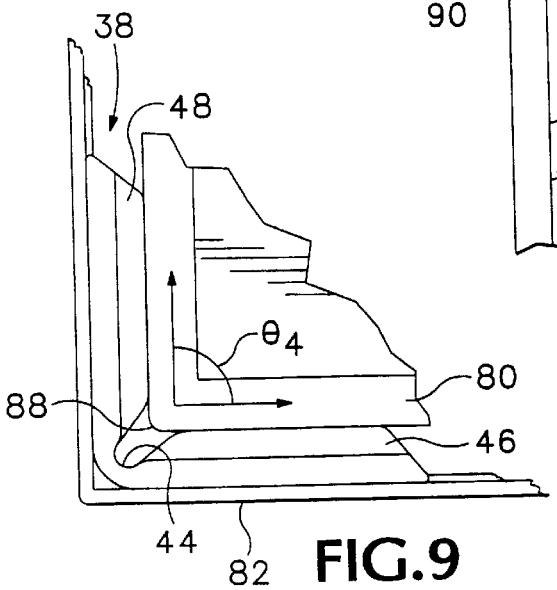
FIG. 9 is a plan view of an edge protector according to the present invention when installed on a furniture article.

FIG. 9, a plan view of an edge protector according to the present invention when installed on a furniture article, illustrates the placement of lands 46 and 48 against adjoining faces of the furniture article 80. The lands and the remainder of the protector 38 hold the article 80 away from the walls of shipping container 82, and provide crushable or deformable structures to absorb impacts and thereby protect edges of the article, for example edge 88.

Figure 15:
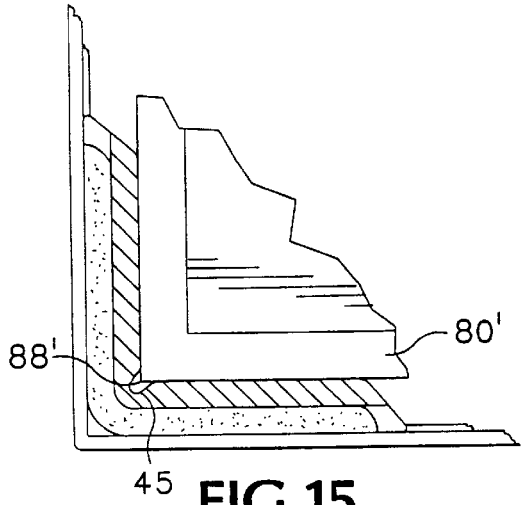
FIG. 15 is a plan view of an edge protector according to an embodiment of the present invention when installed on a furniture article, illustrating the banding region.

FIG. 15 is a plan view of an embodiment of an edge protector according to the present invention, with a partial sectional view of the protector, illustrating the construction of the banding region. In FIG. 15, the product 80' has a truly rectilinear corner 88'. Mini tunnel 45 provided in the banding region where the main tunnel 44 is interrupted at the junction of the lands between the first and second faces of the protector, results in a small volume where the product corner is not in contact with the protector, so as to reduce the possibility of damage to the sharp corner 88' during shipping.

Referring again to FIG. 5, it may be observed that the outer face of the protector at 86 is somewhat rougher than the inner smooth face thereof. This rough outer face provides an advantage in conjunction with the use of shrink wrap or stretch wrap in shipping wherein the protector may be positioned against the furniture item being shipped and the shrink or stretch wrap is then applied. The roughened exterior surfaces of the protector enable the shrink or stretch wrap to have a tactile surface against which to grab or engage. Further, the configuration of the edge protector wherein the angle $\Theta_1$ (FIG. 2) is slightly less than 90° allows the protector to be positioned against the article being shipped, and then when pulled tightly thereagainst, the protector tends to flare outwardly somewhat to conform to the 90° angle. However, the initial configuration being less than 90° provides some tension such that the protector is pushing outwardly as it attempts to return to its original configuration (in molded pulp fiber, for example, the items are somewhat resistant to flexing once dried and are thus likely to attempt the return to the original shape). When used in conjunction with shrink or stretch wrap, which has a tendency to sag and loosen somewhat over time, the edge protector also assists in keeping the wrap taut, since as the wrap relaxes, the edge protector will push outwardly away from the article being protected by a slight amount, taking up the slack in the wrap and maintaining it in a taut condition.

Figure 10:
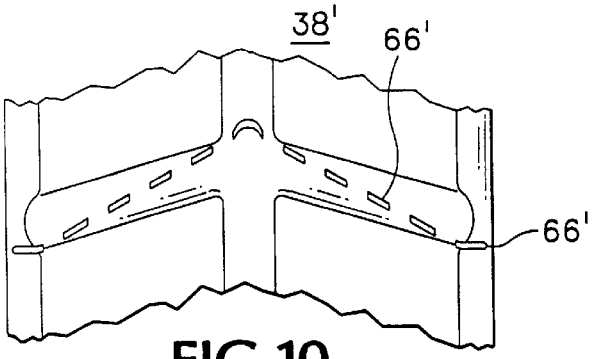
FIG. 10 is a partial inside perspective view of an alternate embodiment of a protector.

The score line 66 is a continuous line in the illustrated embodiment. However, it may be of alternating configuration as shown in FIG. 10, a partial inside perspective view of an alternate embodiment of a protector 38', wherein the line does not extend continuously from one edge through the tunnel along the other edge, but instead is of a perforated type configuration wherein alternating regions of score line 66'/no score line are regularly spaced to still provide relatively smooth separation if desired.

Figure 7:
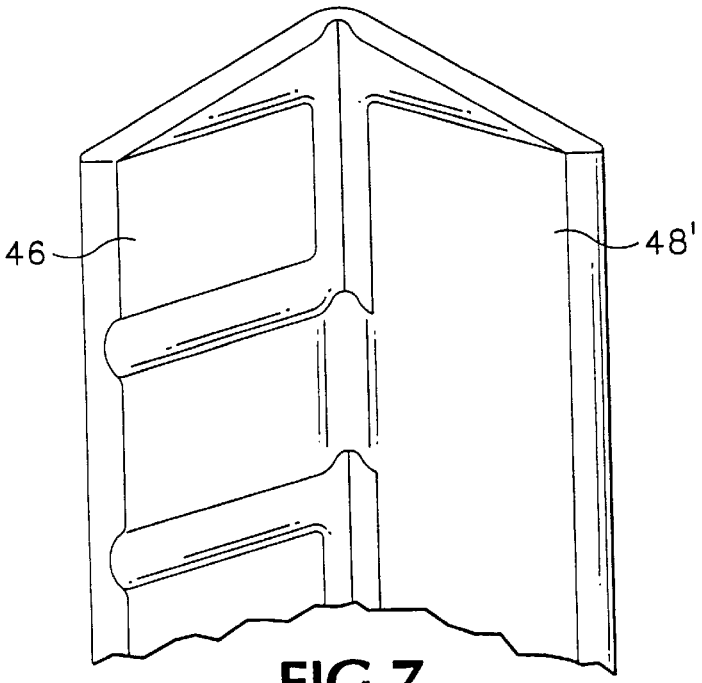
FIG. 7 is an inside perspective view of an alternative embodiment of an edge protector according to the present invention.

Further, while the illustrated embodiment employs a protector with lands having similar width on two faces of the protector, the two edges may have dissimilar rib sizes or, one edge may be constructed as a continuous land or may comprise relatively large lands 48' as shown in FIG. 7.

Further, the protector is suitably constructed of molded fiber, for example molded paper pulp. However, other materials and constructions are also suitable, for example corrugated, honeycomb material, paper maché, extruded polystyrene, or other foam or plastic material may also be employed in a built-up or laminated or fabricated or glued fashion. The hollow portions 56 and 58 may further be filled with either the same material or similar material of which the protector is constructed or, for example, may be filled with some other void-filling, leveling or shock absorbing material (e.g. a molded fiber protector can employ foam inserts within the hollow portions).

Figure 13:
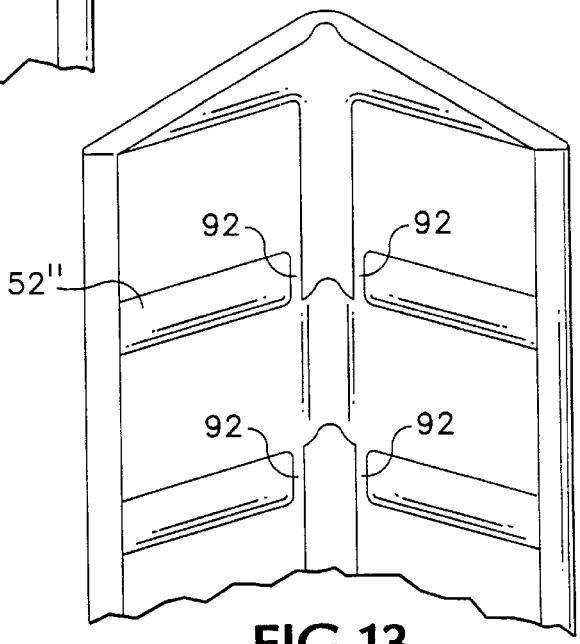
FIG. 13 is a view of a further embodiment of a protector employing "killed" ribs.

Further, an alternate furrow 52" may be constructed so as to not extend into the tunnel portion, employing a stop portion 92 between the furrow and the tunnel as illustrated in FIG. 13. The stop portion 92 suitably connects adjacent lands and may comprise an extension thereof.

Figure 8:
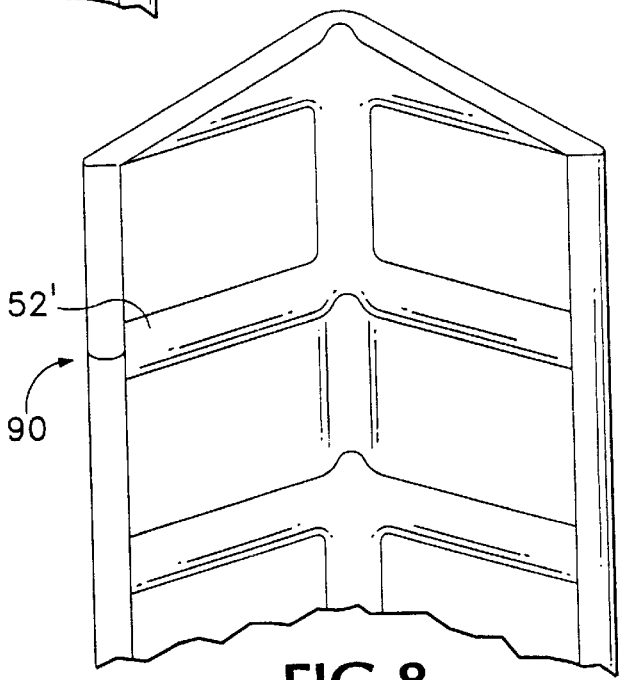
FIG. 8 is an inside perspective view of an alternative embodiment of the edge protector according to the present invention employing closed-ended rib portions.

It may be observed with reference to FIG. 2, that the furrow or rib portions extend substantially from the tunnel portion 44 to the distal edges of the respective sides of the edge protector, providing an "open" furrow portion. The hinging characteristics of the protector along the distal edges thereof can be altered if desired by "closing" the end portions of the ribs to provide a rib region 52' (FIG. 8). The open rib construction of FIG. 2 is more inclined to flex about the opening on impact, whereas the structure of rib 52', given an appropriate type of blow, would be more likely to crack in the region indicated by arrow 90 in FIG. 8. Certain shipping applications may require that such cracking occur, for example to provide an indication of whether an undesired impact occurred during shipping or not. Other situations may not wish such failure to occur and accordingly the structure of FIG. 2 is suitably employed.

Figure 4:
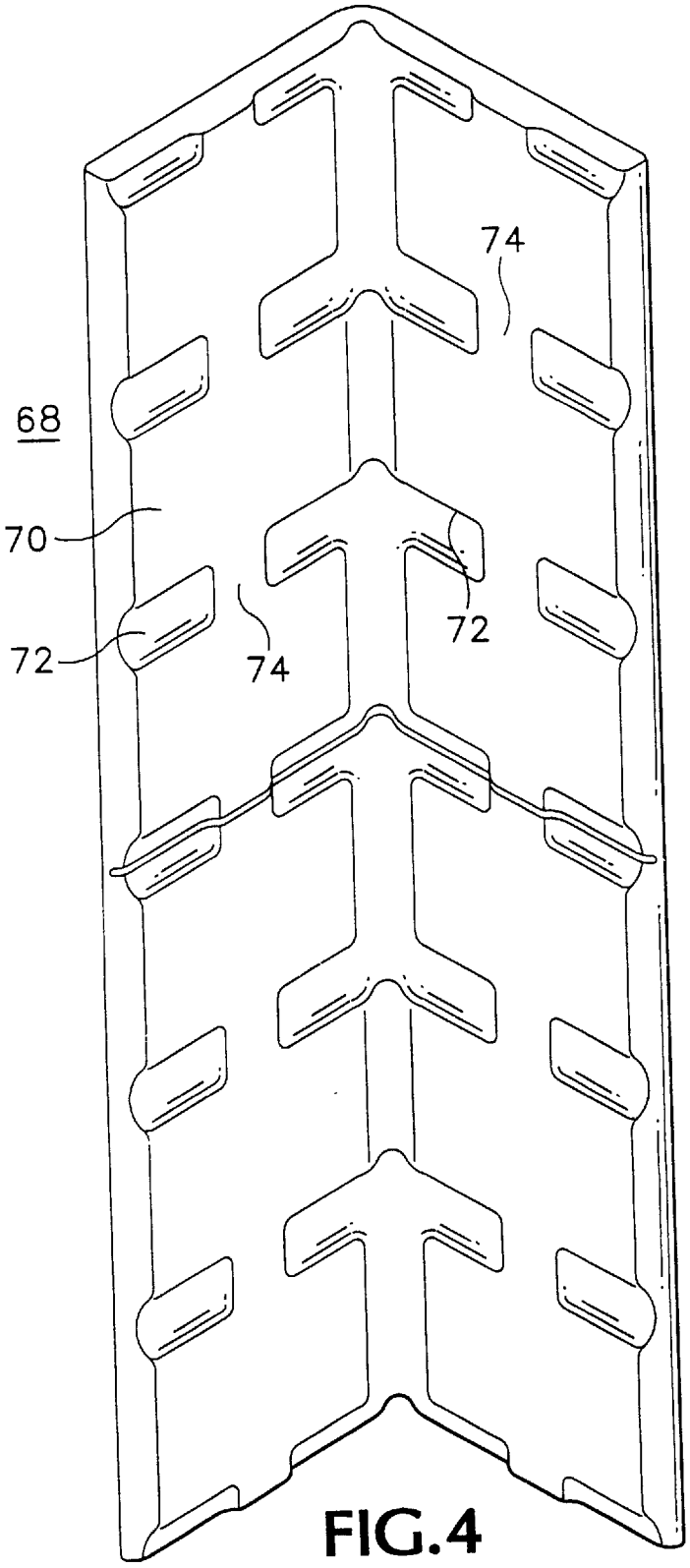
FIG. 4 is an inside perspective view of an edge protector according to an alternative embodiment of the present invention employing a modified ribbing structure.

FIG. 4 is an inside perspective view of an edge protector according to the present invention employing an alternative embodiment ribbing structure for preventing entry of articles into the furrows. The alternative protector 68 employs lands and ribs 70, 72 which are oriented at essentially 90° relative to the longitudinal axis of the protector. However, each rib or furrow 72 carries a central land 74 therein wherein the central land comprises an elevated portion 74 which is at least partially as high as the lands 70. These elevated portions thereby prevent the entry of a shelf or similar article into the ribs and tunnel portion.

While the illustrated embodiments are edge protectors adapted for use with articles of substantially right angle orientation (i.e. $\Theta_4$=90° (FIG. 9)), other angles may be envisioned as necessary. Depending upon the configuration of the article being shipped, $\Theta_4$ may be greater or less than 90°, with attendant changes in the angle $\Theta_1$ (FIG. 2). Also, the first and second edge portions may be of equal width, wherein line AB (FIG. 2) and BC are of equal length (e.g. 3 inches), but may also employ unequal width portions (e.g. AB≈BC).

Figure 12:
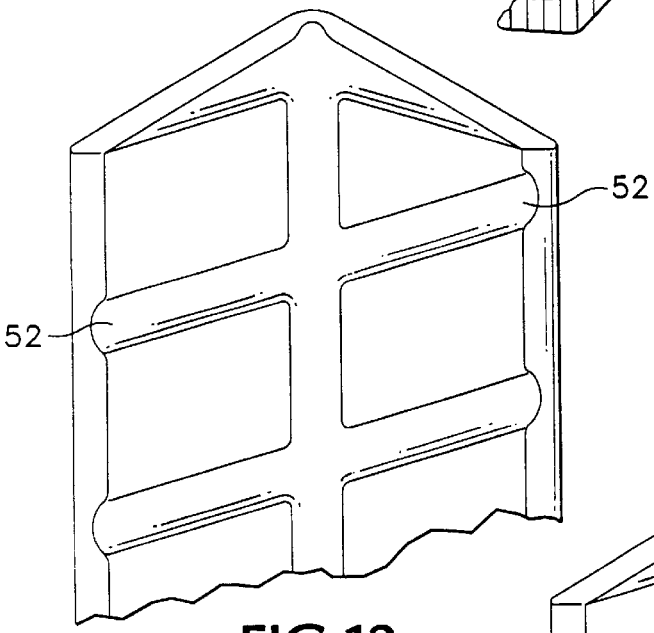
FIG. 12 is a view of another embodiment of a protector.

A still further embodiment of a protector according to the present invention is shown in FIG. 12, wherein ribs or furrows are arranged to define a diagonal pattern when considered in plan view. Entry of an article into the ribs is also thereby prevented.

In a yet further embodiment of a protector according to the present invention, the height and cross-sectional shaping of the rib portions of the protector may differ, providing two or more different height ribs facing outwardly of the protector. The taller ribs extend further outwardly and are accordingly contacted first by a uniformly (with respect to a given locality) applied external force. The taller ribs therefore yield or deform first, partially absorbing the applied load before the load is applied to the less tall ribs. The shorter height ribs are suitably "stiffer", acting as overload or stiffening members if an external force sufficient to deform the taller ribs is applied.

The cross-sectional shape, spacing and height of the various ribs is varied depending upon the particular shipping requirements, the amount of protection to be provided by the edge, corner or face protector and the particular article being protected. The result of the combined varied rib heights and geometries furnishes extended deceleration time of externally applied forces, providing diminished transmission of shock to the article being protected and giving improved residual protection after multiple impacts.

Figure 14:
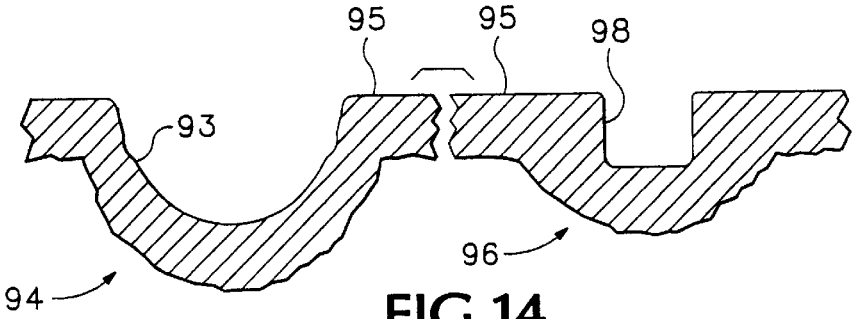
FIG. 14 is a partial sectional view of a multiple rib height embodiment of a protector according to the present invention.

The greater height of a particular rib and the resulting partial deformation thereof further provides advantageous vibration dampening and attenuation protective characteristics to the package at relatively low loading forces. The product is thereby protected from the potentially damaging effects of vibration caused forces, which are ever-present in the transportation environment in which all products are shipped. Improved residual protection is also provided after multiple impacts. Referring to FIG. 14, for example, which is a partial sectional view of a multiple rib height embodiment of a protector according to the present invention, the taller rib 94 has rib walls 93 shaped in a more curved manner, so as to be more prone to gentle deformation as a result of impacts. The shorter rib 96, which may be spaced between adjacent taller ribs with a land 95 therebetween, or which may have multiple taller ribs and lands therebetween (or vice versa), is shaped with a more crush resistant profile, for example one way of achieving this is to employ more vertically oriented walls 98, to provide a hard "final stop" in the event of sufficient impacts to cause the taller ribs to be deformed below the height of the shorter ribs. Other ways are also possible. The product is thereby maintained in spaced relation with the exterior packaging or the like, even in the event of excessive impacts during shipping.

Figure 16:
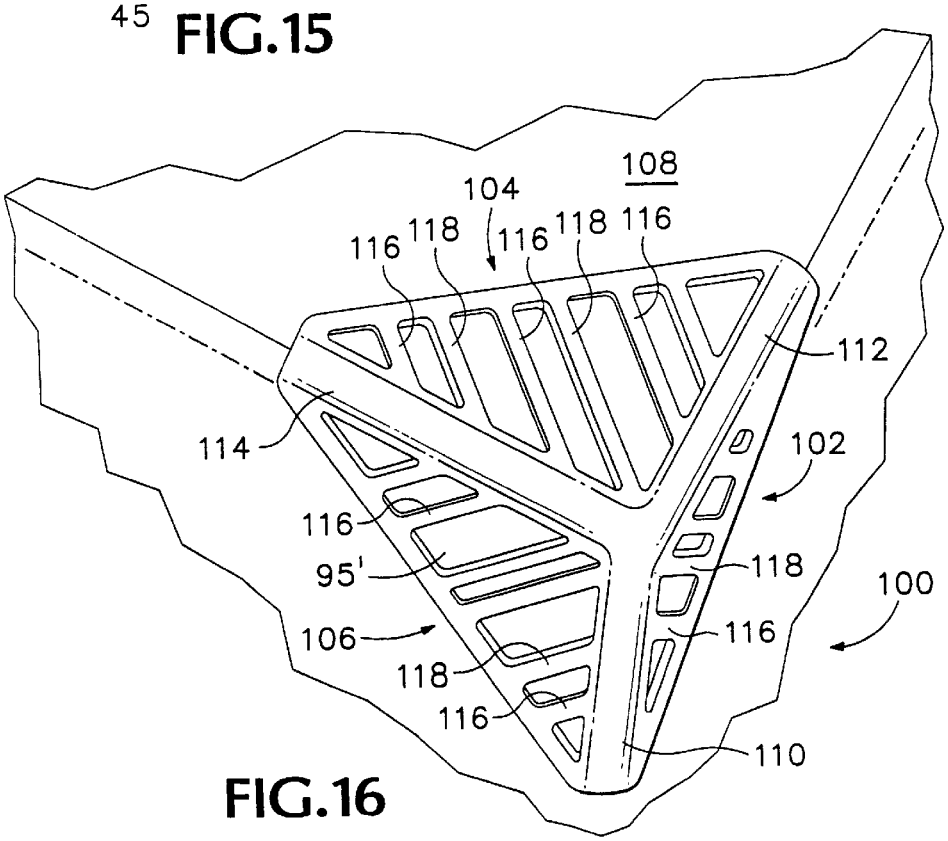
FIG. 16 is a perspective view of a corner protector employing multiple height ribs.

FIG. 16 is a perspective view of a corner protector employing multiple height ribs. Corner protectors, for example as shown in U.S. Pat. No. 3,762,626 (Dorsey), provide protection to a corner of a shipped product. In accordance with a multiple rib height embodiment of the invention, a multiple rib height corner protector 100 has three triangular shaped faces 102, 104 and 106 which are adapted to meet corresponding faces of a shipped article 108. The protector's faces are joined at tunnels 110, 112 and 114. Inwardly facing lands 95' corresponding to lands 95 of FIG. 14 (viewed from the back in FIG. 16) contact respective faces of the article 108. Ribs 116 and 118 are formed on the exterior faces of the protector (with corresponding furrows on the interior faces), wherein ribs 116 are suitably of different height than ribs 118. The lower height ribs 116 may comprise a cross sectional profile corresponding to ribs 96 of FIG. 14, to provide a "hard stop", while ribs 118 may be formed to be more prone to gentle deformation, similar to ribs 94 of FIG. 14. Accordingly, a cross sectional view along a selected face 102, 104 or 106 of protector 100 provides a profile corresponding to the profile of the edge protector shown in FIG. 14. An improved corner protector is thereby provided which at first gently deforms and absorbs impacts, but provides a relatively firm final stop point to maintain a degree of protection even in the event of multiple impacts or the event of an excessively strong impact.

A still further alternative embodiment of a protector according to the present invention does not employ a tunnel 44, suitably for shipping products with non-rectilinear corners.

The protector may suitably be provided with a removable protective liner 35 (shown in phantom in FIG. 5) comprising foam, wadding, molded fiber, for examples, to assist in cushioning the product. Alternatively, coatings may be sprayed on to the edge protector or applied by dipping or otherwise impregnated into the protector to provide added cushioning, environmental resistance to the protector (e.g. against moisture, abrasion resistance), or the like.

While the illustrated embodiments employ edge flange portions 37 at each side of the protector (FIG. 3), alternative embodiments may employ no edge flanges or may employ such a flange 37 on only a single edge or intermittently provide edge flanges.

An improved shipping protector is accordingly provided wherein the protector is resistant to hinging and provides a banding saddle for efficient use of banding straps when shipping. The protector provides an interference fit or non-aligning fit, to prevent the likelihood of shipped articles being aligned with rib portions of the protector and to reduce the likelihood of portions of a product sliding in and out of a rib during shipping. The configuration of the ribs and lands of the protector enable use with relatively thin flat articles, while still preventing entry of the articles into the ribs and undesired movement during shipping. Varied rib configurations, for example in corner, face, or edge protectors, provide progressive failure and final "hard stop" positions in the event of multiple impacts or the like. While edge and corner protectors are illustrated, face protectors employing aspects of the invention may also be provided to cushion a face of a shipped article.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A protector for protecting an article, comprising:

a first edge portion having plural first lands thereon in spaced relation to one another defining a first face of said edge protector, said first lands being separated from one another by first furrows therebetween; and means for preventing entry of the article into ones of said first furrows.

2. A protector for protecting an article according to claim 1 wherein said means for preventing entry comprises the orientation of said first lands and furrows being such that a first furrow between a pair of adjacent ones of said first lands is oriented such that edges of said adjacent first lands define an angle of less than 90 degrees and greater than zero degrees relative to a longitudinal axis of said first edge portion.

3. A protector for protecting an article according to claim 1 wherein said means for preventing entry comprises a stop land positioned in a furrow between adjacent ones of said first lands.

4. A protector for protecting an article according to claim 1 wherein a corresponding rib portion is formed opposite a said first furrow on a back side of said first face of said protector.

5. A protector for protecting an article according to claim 1 wherein portions of said plural first lands at transitions between said first lands and said first furrows are radiused to provide a gentle contact edge.

6. A protector for protecting an article according to claim 4 wherein said first lands include a yielding perimeter for providing controlled progressive deformation under transitional loading, for providing a relatively smooth failure curve.

7. A protector for protecting an article according to claim 1 further comprising a separation means for assisting in separating a first piece of said protector from a second piece of said protector, said separation means longitudinally traversing a portion of said first furrow, said separation means being oriented at a substantially 90 degree angle relative to a longitudinal axis of said first edge portion.

8. A protector for protecting an article according to claim 7 wherein said separation means comprises a substantially continuous score line extending along the length of said first furrow.

9. A protector for protecting an article according to claim 7 wherein said separation means comprises at least two spaced score lines extending along at least a portion of said first furrow.

10. A protector for protecting an article according to claim 1 further comprising a second edge portion having at least one second land thereon defining a second face of said protector.

11. A protector for protecting an article according to claim 1 further comprising a second edge portion having plural second lands thereon in spaced relation to one another defining a second face of said protector.

12. A protector for protecting an article according to claim 11 wherein ones of said plural first lands correspond to ones of said second lands.

13. A protector for protecting an article according to claim 11 further comprising a join member disposed between and joining said first edge portion and said second edge portion.

14. A protector for protecting an article according to claim 11 further comprising a longitudinal tunnel defined between ones of said first and second lands for joining said first edge portion and said second edge portion.

15. A protector for protecting an article according to claim 11 wherein said second lands are separated from one another by second furrows therebetween.

16. A protector for protecting an article according to claim 15 wherein a corresponding rib portion is formed opposite said second furrow on a back side of said second face of said protector.

17. A protector for protecting an article according to claim 15 wherein a selected second furrow between a pair of adjacent ones of said second lands is oriented such that edges of said adjacent second lands define and angle of less than 90 degrees relative to a longitudinal axis of said second edge portion.

18. A protector for protecting an article according to claim 13 further comprising a separation means for assisting in separating a first piece of said protector from a second piece of said protector, said separation means longitudinally traversing a portion of said first furrow, said join member and said second furrow, said separation means being oriented at a substantially 90 degree angle relative to a longitudinal axis of said first edge portion.

19. A protector for protecting an article according to claim 18 wherein said separation means comprises a substantially continuous score line extending along the length of said first furrow, said join member and said second furrow, thereby enabling square ended separation of the first piece from the second piece.

20. A protector for protecting an article according to claim 18 wherein said separation means comprises at least two spaced score lines extending along at least a portion of said first furrow, said join means and said second furrow, thereby enabling square ended separation of the first piece from the second piece.

21. A protector for protecting an article according to claim 14 wherein said tunnel portion is interrupted at a selected position between a selected first land and a selected second land, for imparting a degree of resistance to hinging movement of said first and second edge portions relative to each other.

22. A protector for protecting an article according to claim 14 wherein a portion of a face of said protector opposite the face carrying said tunnel portion comprises a banding saddle, for accommodating a securing strap or other closure media therein.

23. A protector for protecting an article according to claim 14 wherein said tunnel portion is interrupted at a selected position between a selected first land and a selected second land, and wherein a portion of a face of said protector opposite the face carrying said tunnel portion comprises a banding saddle, said interrupted portion and said banding saddle thereby providing a crush resistant region for accommodating a securing strap therein.

24. A protector for protecting an article according to claim 1 wherein said protector comprises molded fiber.

25. A protector for protecting an article according to claim 1 wherein said first furrow portion extends substantially the entire width of said first edge portion.

26. A protector for protecting an article according to claim 13 wherein said first furrow portion extends at least a portion of the entire width of said first edge portion, but does not extend to an edge of said first edge portion distal from said join member.

27. A protector for protecting an article according to claim 13 wherein said first furrow portion extends at least a portion of the entire width of said first edge portion, but does not extend to an edge of said first edge portion adjacent to said join member.

28. A protector for protecting an article according to claim 10, further comprising means for resisting hinging of said first edge relative to said second edge.

29. A protector according to claim 10 wherein said first edge portion and said second edge portion are joined to define a tunnel portion therebetween, wherein said tunnel portion is interrupted at spaced positions.

30. A protector for protecting an article according to claim 10 wherein said first furrow portion extends substantially the entire width of said first edge portion.

31. A protector according to claim 13 wherein the distance from said join member to a distal edge of said first edge is substantially equal to the distance from said join member to a distal edge of said second edge.

32. A protector according to claim 13 wherein the distance from said join member to a distal edge of said first edge is substantially unequal to the distance from said join member to a distal edge of said second edge.

33. A protector according to claim 1 having a back side portion with a textured surface for providing a surface grabbable by a wrapping film.

34. A protector according to claim 1 further comprising a liner member positioned between the article and said first face of the protector.

35. A protector for protecting an article, wherein the protector is adapted to be positioned between the article and an outer closure media, comprising:

a first edge portion having a first inner face comprising first plural lands adapted for contacting the article along a first axis thereof; and a second edge portion having a second inner face portion comprising at least one second land adapted for contacting the article along a second axis thereof, wherein said first and second edge portions are joined to one another at an angle of approximately 90 degrees by a tunnel portion, said tunnel portion being interrupted at predetermined intervals.

36. A protector for protecting an article according to claim 35 comprising plural second lands, wherein furrows are defined between adjacent ones of said first lands, and between adjacent ones of said second lands, said furrows being longitudinally oriented at an angle of less than 90 degrees to a longitudinal axis of said first edge portion and said second edge portion, thereby defining a herringbone pattern.

37. A protector for protecting an article according to claim 35 comprising plural second lands, wherein furrows are defined between adjacent ones of said first lands, longitudinally oriented at an angle of less than 90 degrees to a longitudinal axis of said first edge portion and wherein furrows are defined between adjacent ones of said second lands longitudinally oriented at an angle of greater than 90 degrees to a longitudinal axis of said second edge portion.

38. A protector for protecting an article according to claim 36 wherein said furrows join with said tunnel portion.

39. A protector for protecting an article according to claim 36 wherein said furrows are substantially unjoined with said tunnel portion.

40. A protector for protecting an article according to claim 38 further comprising a separation portion for assisting in separating a first piece of said protector from a second piece of said protector, said separation portion being positioned longitudinally along a portion of a furrow adjacent a first land, said tunnel portion and a portion of a furrow adjacent a second land, said separation portion being oriented at a substantially 90 degree angle relative to a longitudinal axis of said first edge portion.

41. A protector for protecting an article according to claim 40 wherein said separation portion comprises a substantially continuous score line.

42. A protector for protecting an article according to claim 40 wherein said separation portion comprises at least two spaced score lines.

43. A protector for protecting an article according to claim 40 wherein said separation portion is substantially positioned other than on a face of said edge protector which contacts the article.

44. A protector for protecting an article according to claim 35 wherein edges of said first and at least one second lands are radiused in areas adjacent said furrows and said tunnel portion, for defining a smoother line of contact of said protector against the article.

45. A protector for protecting an article according to claim 35 wherein said protector comprises molded fiber.

46. A protector for protecting an article according to claim 35 wherein said tunnel is interrupted by means for resisting hinging of said first edge relative to said second edge.

47. A protector for protecting an article according to claim 36 wherein said first furrow portion extends substantially the entire width of said first edge portion.

48. A protector for protecting an article according to claim 36 wherein said first furrow portion extends at least a portion of the entire width of said first edge portion, but does not extend to an edge of said first edge portion distal from said join member.

49. A shippable structure comprising:

a product to be shipped; and a shipping protector adapted for placement against at least an edge of said product, said shipping protector comprising means for providing a non-aligning fit against said product for maintaining said product in relatively fixed spaced relation to said shipping protector.

50. A shippable structure according to claim 49 wherein said product to be shipped comprises a ready to assemble furniture product.

51. A shippable structure comprising:

a product to be shipped; and a shipping protector adapted for placement against at least an edge of said product, said shipping protector comprising means for providing an interference fit against said product for maintaining said product in relatively fixed spaced relation to said shipping protector, wherein said shipping protector comprises:

a first edge portion having a first inner face adapted for contacting the product along a first axis thereof, said first inner face comprising at least one rib portion, wherein said means for providing an interference fit comprises the orientation of said at least one rib portion being such that edges of said at least one rib portion are oriented at an angle of less than 90 degrees relative to a longitudinal axis of said first edge portion, thereby preventing entry of said product into said at least one rib portion.

52. A shipping protector comprising:

a first elongate rib member for initially absorbing impact shock and accommodating deformation; and a second elongate rib member relatively resistant to deformation for providing a hard stop against further deformation of the shipping protector beyond a point of deformation of said first member, wherein said first and second elongate ribs are elongate substantially in a first plane, and wherein the deformation is substantially in a plane other than said first plane.

53. A shipping protector according to claim 52 wherein said second elongate rib member is of lesser height than said first elongate rib member, whereby said first elongate rib member initially receives a shock of an impact before said second elongate rib member receives the shock of the impact.

54. A shipping protector according to claim 52 wherein said shipping protector comprises an edge protector.

55. A shipping protector according to claim 52 wherein said shipping protector comprises a corner protector.

56. A shipping protector according to claim 52 wherein said shipping protector comprises a face protector.

57. A shipping protector comprising:

a first tunnel member;

a second tunnel member intersecting with said first tunnel member at a first end of said first and second tunnel members respectively, wherein said first and second tunnels define a first plane in an area therebetween;

at least one first rib member defined in the area between said tunnels with a height substantially within said first plane; and at least one second rib member defined in the area between said tunnels with a height substantially within a second plane.

58. A shipping protector according to claim 57 wherein said second plane is closer to a plane of the shipping protector in which the protector engages an article face than is said first plane.

59. A shipping protector according to claim 57 further comprising:

a third tunnel member, wherein said third tunnel member and said second tunnel member intersect at a first end of the second tunnel member and a first end of the third tunnel member, wherein said second and third tunnel members define a third plane in an area therebetween; and at least one third rib member defined in the area between said second and third tunnels with a height substantially within the third plane.

60. A shipping protector according to claim 59 further comprising at least one fourth rib member defined with a height substantially within a fourth plane parallel to the third plane.

61. A shipping protector according to claim 59 wherein said third tunnel member and said first tunnel member intersect at the first end of the first tunnel member and the first end of the third tunnel member, wherein said first and third tunnel members define a fifth plane in an area therebetween; and at least one fourth rib member defined in the area between said first and third tunnels with a height substantially within the fifth plane.

62. A shipping protector according to claim 61 further comprising at least one fifth rib member defined with a height substantially within a sixth plane parallel to the fifth plane.

63. A shipping protector comprising:

a first tunnel;

a second tunnel;

a flange member, wherein said first and second tunnels intersect with one another, and wherein said flange member intersects with said first and second tunnels, said flange member and said first and second tunnels defining a first plane of the shipping protector;

at least one first rib member defined with a height in a second plane; and at least one second rib member defined with a height in a third plane, wherein said second plane is between said first and third planes.

64. A shipping protector according to claim 63 comprising at least two of said second rib members.

65. A shipping protector comprising:

a first edge member with at least one land thereon defining a first plane against which an article can rest;

a first tunnel member positioned along a first edge of said first edge member;

at least one rib defined in said first edge member, wherein a bearing surface of said first rib defines a second plane in spaced relation with said first plane and against which an impact can occur; and at least one second rib defined in said first edge member wherein a bearing surface of said second rib defines a third plane intermediate said first and second planes, said second rib defining a second impact site.

66. A shipping protector according to claim 65 further comprising:

a second edge member, wherein a first edge of said second edge member is adjacent said first tunnel.

67. A shipping protector according to claim 66 further comprising:

at least one land defined on said second edge member, defining a fourth plane against which an article can rest;

at least one rib defined in said second edge member, wherein a bearing surface of said rib defines a fifth plane in spaced relation with said fourth plane and against which an impact can occur; and at least one second rib defined in said second edge member wherein a bearing surface of said second rib defines a sixth plane intermediate said fourth and fifth planes, said second rib defining a second impact site.

68. A shipping protector according to claim 66 further comprising:

a second tunnel;

a third tunnel; and a third edge member, wherein said second tunnel is defined between a second edge of said second edge member and a first edge of said third edge member and wherein said third tunnel is defined between a second edge of said first edge member and a second edge of said third edge member.

69. A shipping protector according to claim 68 wherein said second and third tunnels define a fifth plane therebetween and said third and first tunnels define a sixth plane therebetween, wherein said first, fifth and sixth planes are mutually orthogonal to each other.

* * * * *